US008281482B2

(12) United States Patent
McAvoy et al.

(10) Patent No.: US 8,281,482 B2
(45) Date of Patent: Oct. 9, 2012

(54) METHOD OF FABRICATING CRACK-RESISTANT THERMAL BEND ACTUATOR

(75) Inventors: Gregory John McAvoy, Dublin (IE); Vincent Patrick Lawlor, Dublin (IE); Rónán Pádraig Seán O'Reilly, Dublin (IE)

(73) Assignee: Zamtec Limited, Dublin (IE)

( * ) Notice: Subject to any disclaimer, the term of this patent is extended or adjusted under 35 U.S.C. 154(b) by 444 days.

(21) Appl. No.: 12/546,683

(22) Filed: Aug. 25, 2009

(65) Prior Publication Data

US 2011/0047781 A1 Mar. 3, 2011

(51) Int. Cl.
*H05B 3/60* (2006.01)

(52) U.S. Cl. ..... 29/611; 29/846; 29/848

(58) Field of Classification Search ..... 29/611, 29/527.2, 621.1, 846, 848, 874; 347/20, 347/45, 47, 54, 61

See application file for complete search history.

(56) References Cited

U.S. PATENT DOCUMENTS

| | | | | |
|---|---|---|---|---|
| 6,721,020 | B1 * | 4/2004 | Delametter et al. | 349/54 |
| 7,344,226 | B2 * | 3/2008 | Silverbrook | 347/45 |
| 7,901,046 | B2 | 3/2011 | McAvoy et al. | |
| 7,963,634 | B2 | 6/2011 | Yokouchi | |
| 2007/0146436 | A1 | 6/2007 | Cornell et al. | |
| 2008/0043066 | A1 | 2/2008 | Silverbrook | |
| 2008/0129783 | A1 | 6/2008 | McAvoy et al. | |
| 2008/0129795 | A1 | 6/2008 | Mcavoy et al. | |

FOREIGN PATENT DOCUMENTS

| | | |
|---|---|---|
| WO | WO 99/03681 A1 | 1/1999 |

* cited by examiner

*Primary Examiner* — Thiem Phan

(57) ABSTRACT

A method of fabricating a thermal bend actuator comprises the steps of: (a) depositing a first layer comprised of silicon nitride onto a sacrificial scaffold; (b) depositing a second layer comprised of silicon dioxide onto the first layer; (c) depositing an active beam layer onto the second layer; (d) etching the active beam layer, the first layer and the second layer to define the thermal bend actuator; and (e) releasing the thermal bend actuator by removing the sacrificial scaffold.

20 Claims, 7 Drawing Sheets

METHOD OF FABRICATING CRACK-RESISTANT THERMAL BEND ACTUATOR

FIELD OF THE INVENTION

The present invention relates to the field of MEMS devices and particularly inkjet printheads. It has been developed primarily to improve the robustness of thermal bend actuators, both during MEMS fabrication and during operation.

CROSS REFERENCES

The following patents or patent applications filed by the applicant or assignee of the present invention are hereby incorporated by cross-reference.

| | | |
|---|---|---|
| 7,416,280 | 6,902,255 | 6,623,101 |
| 6,406,129 | 6,505,916 | 6,457,809 |
| 6,550,895 | 6,457,812 | 20080129793-A1 |
| 20080129793-A1 | 20080129784-A1 | 20080225076-A1 |
| 20080225077-A1 | 20080225078-A1 | 20090139961 |
| 12/323,471 | 12/508,564 | 20080309728 |
| 12/114,826 | 12/239,814 | 12/142,779 |

The disclosures of these co-pending applications are incorporated herein by reference.

BACKGROUND OF THE INVENTION

The present Applicant has described previously a plethora of MEMS inkjet nozzles using thermal bend actuation. Thermal bend actuation generally means bend movement generated by thermal expansion of one material, having a current passing therethough, relative to another material. The resulting bend movement may be used to eject ink from a nozzle opening, optionally via movement of a paddle or vane, which creates a pressure wave in a nozzle chamber.

The Applicant's U.S. Pat. No. 6,416,167 (the contents of which are incorporated herein by reference) describes an inkjet nozzle having a paddle positioned in a nozzle chamber and a thermal bend actuator positioned externally of the nozzle chamber. The actuator takes the form of a lower active beam of conductive material (e.g. titanium nitride) fused to an upper passive beam of non-conductive material (e.g. silicon dioxide). The actuator is connected to the paddle via an arm received through a slot in the wall of the nozzle chamber. Upon passing a current through the lower active beam, the actuator bends upwards and, consequently, the paddle moves towards a nozzle opening defined in a roof of the nozzle chamber, thereby ejecting a droplet of ink. An advantage of this design is its simplicity of construction. A drawback of this design is that both faces of the paddle work against the relatively viscous ink inside the nozzle chamber.

The Applicant's U.S. Pat. No. 6,260,953 (the contents of which are incorporated herein by reference) describes an inkjet nozzle in which the actuator forms a moving roof portion of the nozzle chamber. The actuator is takes the form of a serpentine core of conductive material encased by a polymeric material. Upon actuation, the actuator bends towards a floor of the nozzle chamber, increasing the pressure within the chamber and forcing a droplet of ink from a nozzle opening defined in the roof of the chamber. The nozzle opening is defined in a non-moving portion of the roof. An advantage of this design is that only one face of the moving roof portion has to work against the relatively viscous ink inside the nozzle chamber. A drawback of this design is that construction of the actuator from a serpentine conductive element encased by polymeric material is difficult to achieve in a MEMS process.

The Applicant's U.S. Pat. No. 6,623,101 (the contents of which are incorporated herein by reference) describes an inkjet nozzle comprising a nozzle chamber with a movable roof portion having a nozzle opening defined therein. The movable roof portion is connected via an arm to a thermal bend actuator positioned externally of the nozzle chamber. The actuator takes the form of an upper active beam spaced apart from a lower passive beam. By spacing the active and passive beams apart, thermal bend efficiency is maximized since the passive beam cannot act as heat sink for the active beam. Upon passing a current through the active upper beam, the movable roof portion, having the nozzle opening defined therein, is caused to rotate towards a floor of the nozzle chamber, thereby ejecting through the nozzle opening. Since the nozzle opening moves with the roof portion, drop flight direction may be controlled by suitable modification of the shape of the nozzle rim. An advantage of this design is that only one face of the moving roof portion has to work against the relatively viscous ink inside the nozzle chamber. A further advantage is the minimal thermal losses achieved by spacing apart the active and passive beam members. A drawback of this design is the loss of structural rigidity in spacing apart the active and passive beam members.

The Applicant's US Publication No. 2008/0129795 (the contents of which are incorporated herein by reference) describes an inkjet nozzle comprising a nozzle chamber with a movable roof portion having a nozzle opening defined therein. The movable roof portion comprises a thermal bend actuator for moving the movable roof portion towards a floor of the chamber. Various means for improving the efficiency of the actuator are described, including the use of porous silicon dioxide for the passive layer of the actuator.

There is a need to improve upon the design of thermal bend inkjet nozzles, so as to achieve more efficient drop ejection and improved mechanical robustness. Mechanical robustness is an important factor in terms of both the operational characteristics of the inkjet nozzle and its fabrication. Fabrication requires a sequence of MEMS fabrication steps to provide a printhead integrated circuit in high overall yield.

SUMMARY OF THE INVENTION

In a first aspect, there is provided a thermal bend actuator comprising:

an active beam for connection to drive circuitry; and a passive beam mechanically cooperating with the active beam, such that when a current is passed through the active beam, the active beam expands relative to the passive beam, resulting in bending of the actuator, wherein the passive beam comprises a first layer comprised of silicon nitride and a second layer comprised of silicon dioxide, the second layer being sandwiched between the first layer and the active beam.

The thermal bend actuator according to the present invention is advantageously robust and resistant to cracking whilst maintaining excellent thermal efficiency. The first layer of silicon nitride provides the crack-resistance whilst the second layer of silicon dioxide provides thermal insulation, which maintains a high overall efficiency. Cracking may be problematic in thermal bend actuators due to inevitable stresses in the active and passive beams, but especially the passive beam which is usually formed from silicon dioxide having good thermally insulating properties. The present invention addresses the problem of cracking by using the bilayered passive beam described herein.

Optionally, the first layer is thicker than the second layer. The first layer of silicon nitride may be between 2 and 20 times thicker than the second layer of silicon dioxide, optionally between 8 and 20 times thicker.

Optionally, the first layer is at least two times thicker than the second layer, optionally at least four time thicker or optionally at least eight times thicker.

Optionally, the second layer has a thickness in the range of 0.01 and 0.5 microns, optionally in the range of 0.02 and 0.3 microns, optionally in the range of 0.05 and 0.2 microns, or optionally about 0.1 microns.

Optionally, the first layer has a thickness in the range of 0.05 and 5.0 microns, optionally in the range of 1.0 and 2.0 microns, or optionally about 1.4 microns.

Optionally, the active beam has a thickness in the range of 0.05 and 5.0 microns, optionally in the range of 1.0 and 3.0 microns, optionally in the range of 1.5 and 2.0 microns, or optionally about 1.7 microns.

Optionally, the active beam is connected to the drive circuitry via a pair of electrical contacts positioned at one end of the actuator.

Optionally, the active beam is fused to the passive beam by a deposition process.

Optionally, the active beam is comprised of a conductive thermoelastic material, which is optionally selected from the group consisting of: titanium nitride, titanium aluminium nitride and an aluminium alloy.

Optionally, the active beam is comprised of a vanadium-aluminium alloy.

In a second aspect, there is provided an inkjet nozzle assembly comprising:

a nozzle chamber having a nozzle opening and an ink inlet; and a thermal bend actuator for ejecting ink through the nozzle opening, the actuator comprising:

an active beam for connection to drive circuitry; and a passive beam mechanically cooperating with the active beam, such that when a current is passed through the active beam, the active beam expands relative to the passive beam, resulting in bending of the actuator, wherein the passive beam comprises a first layer comprised of silicon nitride and a second layer comprised of silicon dioxide, the second layer being sandwiched between the first layer and the active beam.

In addition to the advantages discussed above in respect of the first aspect, a further advantage of inkjet nozzle assemblies according to the second aspect is that the second layer of silicon nitride is an impermeable barrier to the fluid contained in the nozzle chamber. Accordingly, aqueous ions are unable to leach through the passive beam and contaminate the active beam, which may result in nozzle failure. Leaching of aqueous ions from hot ink has been identified by the present Applicants as a failure mechanism for thermal bend actuators having a passive beam comprised of silicon dioxide only.

Optionally, the nozzle chamber comprises a floor and a roof having a moving portion, whereby actuation of the actuator moves the moving portion towards the floor.

Optionally, wherein the moving portion comprises the actuator.

Optionally, the active beam is disposed on an upper surface of the passive beam relative to the floor of the nozzle chamber.

Optionally, the nozzle opening is defined in the moving portion, such that the nozzle opening is movable relative to the floor.

Optionally, the actuator is movable relative to the nozzle opening.

Optionally, the roof is coated with a polymeric material, such as a polymerized siloxane described in further detail herein.

In a third aspect, there is provided an inkjet printhead comprising a plurality of nozzle assemblies, each nozzle assembly comprising:

a nozzle chamber having a nozzle opening and an ink inlet; and a thermal bend actuator for ejecting ink through the nozzle opening, the actuator comprising:

an active beam connected to drive circuitry; and a passive beam mechanically cooperating with the active beam, such that when a current is passed through the active beam, the active beam expands relative to the passive beam, resulting in bending of the actuator, wherein the passive beam comprises a first layer comprised of silicon nitride and second layer comprised of silicon dioxide, the second layer being sandwiched between the first layer and the active beam.

In a fourth aspect, there is provided a MEMS device comprising one or more thermal bend actuators, each thermal bend actuator comprising:

an active beam connected to drive circuitry; and a passive beam mechanically cooperating with the active beam, such that when a current is passed through the active beam, the active beam expands relative to the passive beam, resulting in bending of the actuator, wherein the passive beam comprises a first layer comprised of silicon nitride and second layer comprised of silicon dioxide, the second layer being sandwiched between the first layer and the active beam.

Examples of such MEMS devices include LOC valves and LOC pumps (as described in the Applicant's U.S. application Ser. No. 12/142,779), sensors, switches etc. The skilled person would be well aware of the plethora of applications for MEMS devices comprising thermal bend actuators.

In a fifth aspect, there is provided a method of fabricating a thermal bend actuator comprising the steps of:

(a) depositing a first layer comprised of silicon nitride onto a sacrificial scaffold;

(b) depositing a second layer comprised of silicon dioxide onto the first layer;

(c) depositing an active beam layer onto the second layer;

(d) etching the active beam layer, the first layer and the second layer to define the thermal bend actuator, the thermal bend actuator comprising an active beam and a passive beam, the passive beam comprising the first and second layers; and (e) releasing the thermal bend actuator by removing the sacrificial scaffold.

Optionally, the sacrificial scaffold is comprised of photoresist or polyimide.

Optionally, the sacrificial scaffold is removed by an oxidative plasma, known in the art as 'ashing'. Ashing may be achieved using an $O_2$ plasma, an $O_2/N_2$ plasma or any other suitable oxidizing plasma.

Optionally, residual stresses in the passive beam after release of the thermal bend actuator reside predominantly in the first layer.

Optionally, the method forms at least part of a MEMS fabrication process for an inkjet nozzle assembly.

Optionally, the first and second layers define a roof of a nozzle chamber.

Optionally, the roof comprises a moving portion, the moving portion including the thermal bend actuator.

Optionally, a nozzle opening is defined in the roof prior to release of the thermal bend actuator.

Optionally, the nozzle opening is defined in the moving portion of the roof.

Optionally, the roof is coated with a polymeric material prior to releasing the thermal bend actuator.

Optionally, the polymeric material is protected with a metal layer prior to releasing the thermal bend actuator.

Optionally, the polymeric material is coated on the roof by a spin-on process.

Optionally, the polymeric material is a polymerized siloxane, such as polydimethylsiloxane, polymethylsilsesquioxane or polyphenylsilsesquioxane.

Of course, it will be appreciated that optional aspects described in connection with the thermal bend actuator according to the first aspect are equally applicable to the second, third, fourth and fifth aspects.

BRIEF DESCRIPTION OF THE DRAWINGS

Optional embodiments of the present invention will now be described by way of example only with reference to the accompanying drawings, in which.

DESCRIPTION OF OPTIONAL EMBODIMENTS

It will be appreciated that the present invention may be used in connection with any thermal bend actuator having an active beam fused to a passive beam. Such thermal bend actuators find uses in many MEMS devices, including inkjet nozzles, switches, sensors, pumps, valves etc. For example, the Applicant has demonstrated the use of thermal bend actuators in lab-on-a-chip devices as described in U.S. application Ser. No. 12/142,779, the contents of which are herein incorporated by reference, and a plethora of inkjet nozzles described in the cross-referenced patents and patent applications identified herein. Although MEMS thermal bend actuators find many different uses, the present invention will be described herein with reference to one of the Applicant's inkjet nozzle assemblies. However, it will, of course, be appreciated that the present invention is not limited to this particular device.

FIGS. 1 to 13 show a sequence of MEMS fabrication steps for an inkjet nozzle assembly 100 described in the Applicant's earlier US Publication No. US 2008/0309728, the contents of which are herein incorporated by reference. The completed inkjet nozzle assembly 100 shown in FIGS. 12 and 13 utilizes thermal bend actuation, whereby a moving portion of a roof bends towards a substrate resulting in ink ejection.

The starting point for MEMS fabrication is a standard CMOS wafer having CMOS drive circuitry formed in an upper portion of a silicon wafer. At the end of the MEMS fabrication process, this wafer is diced into individual printhead integrated circuits (ICs), with each IC comprising drive circuitry and plurality of nozzle assemblies.

Figure 1:
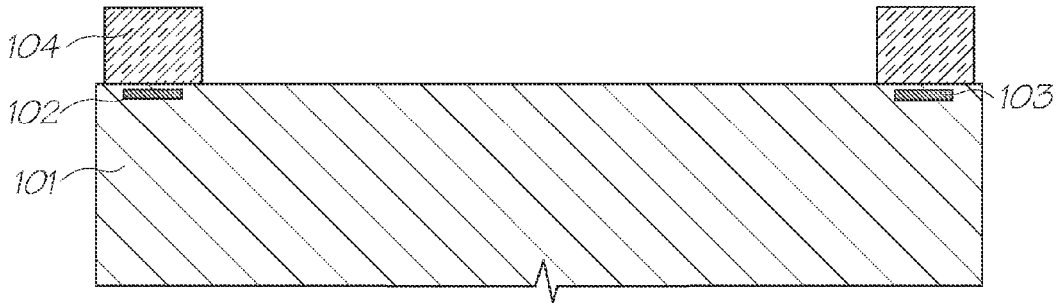
FIG. 1 is a side-sectional view of a partially-fabricated alternative inkjet nozzle assembly after a first sequence of steps in which nozzle chamber sidewalls are formed.
Figure 2:
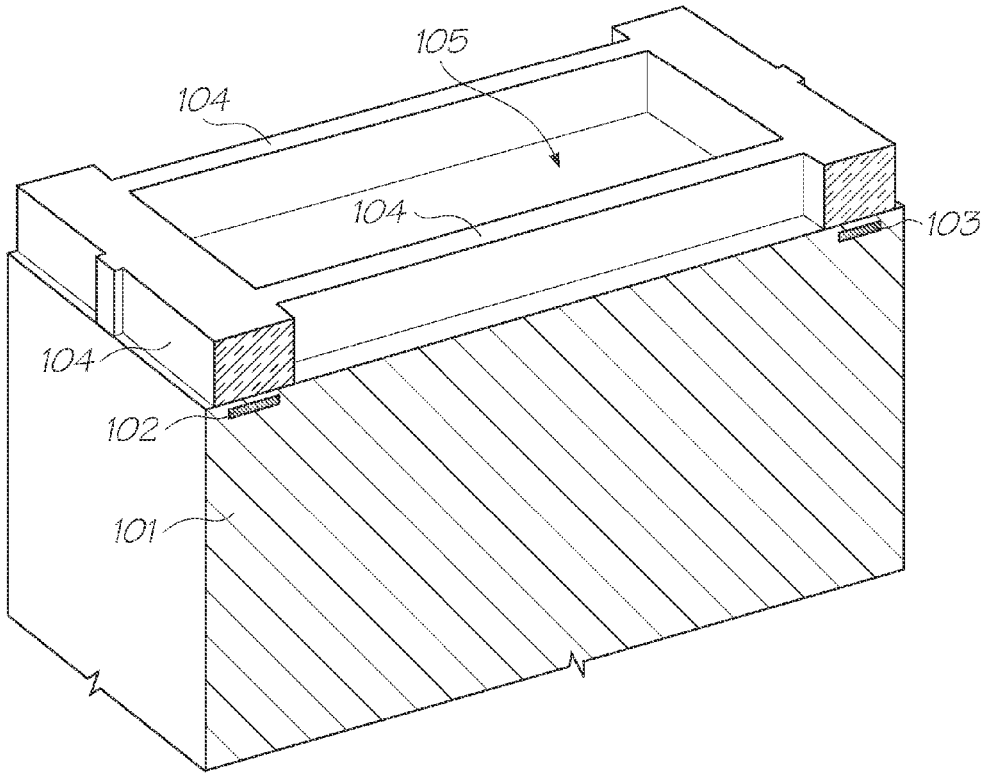
FIG. 2 is a perspective view of the partially-fabricated inkjet nozzle assembly shown in FIG. 1.

As shown in FIGS. 1 and 2, a substrate 101 has an electrode 102 formed in an upper portion thereof. The electrode 102 is one of a pair of adjacent electrodes (positive and earth) for supplying power to an actuator of the inkjet nozzle 100. The electrodes receive power from CMOS drive circuitry (not shown) in upper layers of the substrate 101.

The other electrode 103 shown in FIGS. 1 and 2 is for supplying power to an adjacent inkjet nozzle. In general, the drawings shows MEMS fabrication steps for a nozzle assembly, which is one of an array of nozzle assemblies. The following description focuses on fabrication steps for one of these nozzle assemblies. However, it will of course be appreciated that corresponding steps are being performed simultaneously for all nozzle assemblies that are being formed on the wafer. Where an adjacent nozzle assembly is partially shown in the drawings, this can be ignored for the present purposes. Accordingly, the electrode 103 and all features of the adjacent nozzle assembly will not be described in detail herein. Indeed, in the interests of clarity, some MEMS fabrication steps will not be shown on adjacent nozzle assemblies.

In the sequence of steps shown in FIGS. 1 and 2, an 8 micron layer of silicon dioxide is initially deposited onto the substrate 101. The depth of silicon dioxide defines the depth of a nozzle chamber 105 for the inkjet nozzle. After deposition of the $SiO_2$ layer, it is etched to define walls 104, which will become sidewalls of the nozzle chamber 105.

Figure 3:
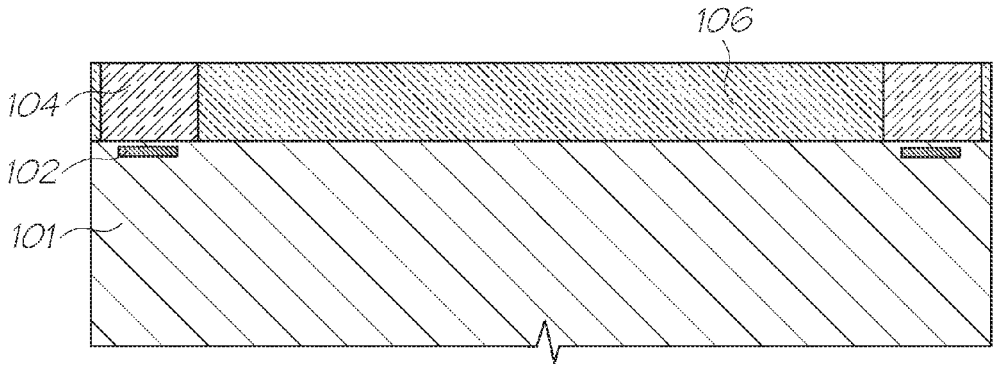
FIG. 3 is a side-sectional view of a partially-fabricated inkjet nozzle assembly after a second sequence of steps in which the nozzle chamber is filled with polyimide.
Figure 4:
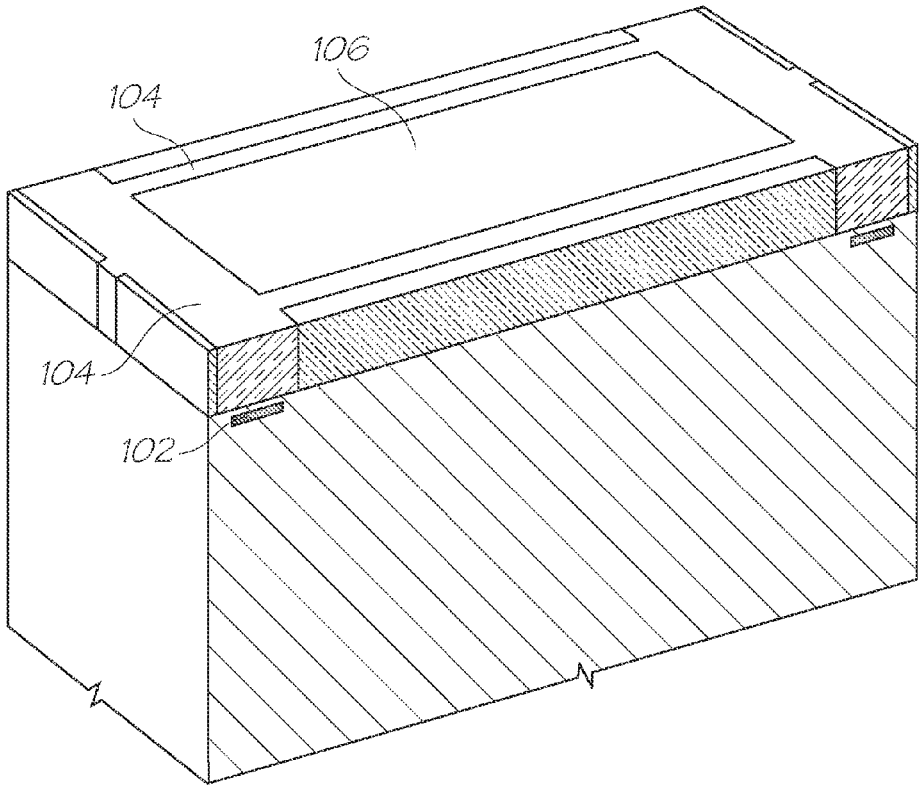
FIG. 4 is a perspective view of the partially-fabricated inkjet nozzle assembly shown in FIG. 3.

As shown in FIGS. 3 and 4, the nozzle chamber 105 is then filled with photoresist or polyimide 106, which acts as a sacrificial scaffold for subsequent deposition steps. The polyimide 106 is spun onto the wafer using standard techniques, UV cured and/or hardbaked, and then subjected to chemical mechanical planarization (CMP) stopping at the top surface of the $SiO_2$ wall 104.

Figure 5:
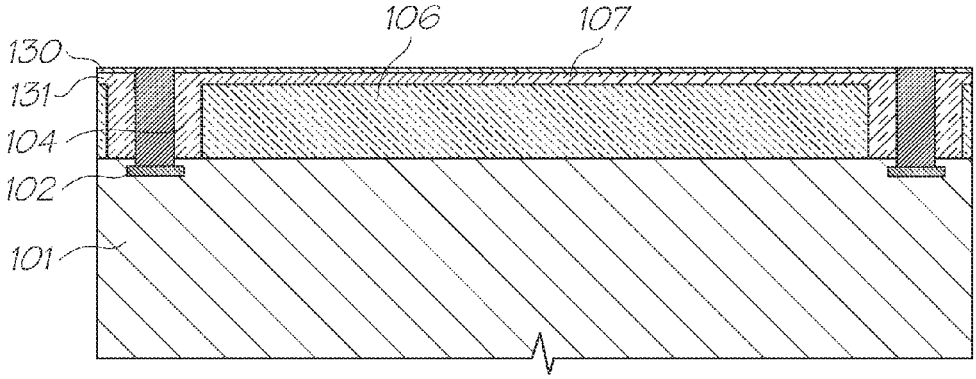
FIG. 5 is a side-sectional view of a partially-fabricated inkjet nozzle assembly after a third sequence of steps in which connector posts are formed up to a chamber roof.
Figure 6:
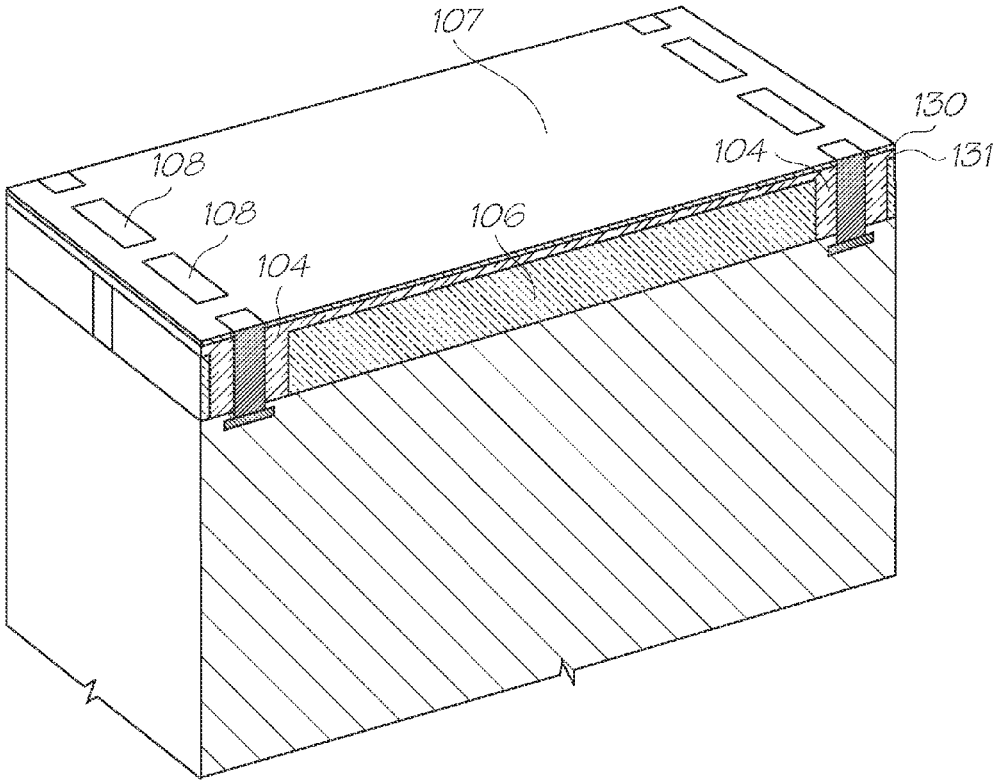
FIG. 6 is a perspective view of the partially-fabricated inkjet nozzle assembly shown in FIG. 5.
Figure 12:
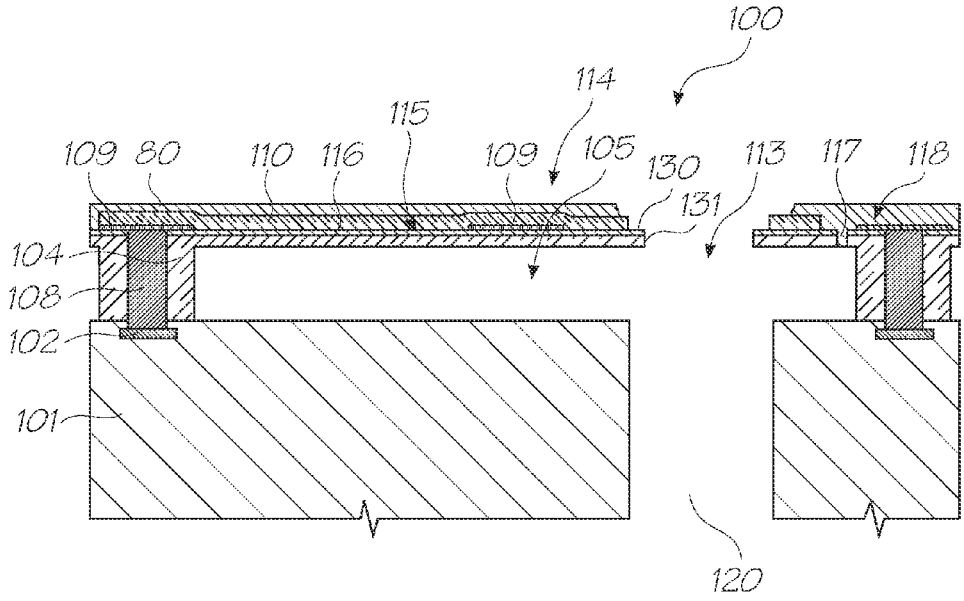
FIG. 12 is a side-sectional view of completed inkjet nozzle assembly, after backside MEMS processing and removal of photoresist.
Figure 13:
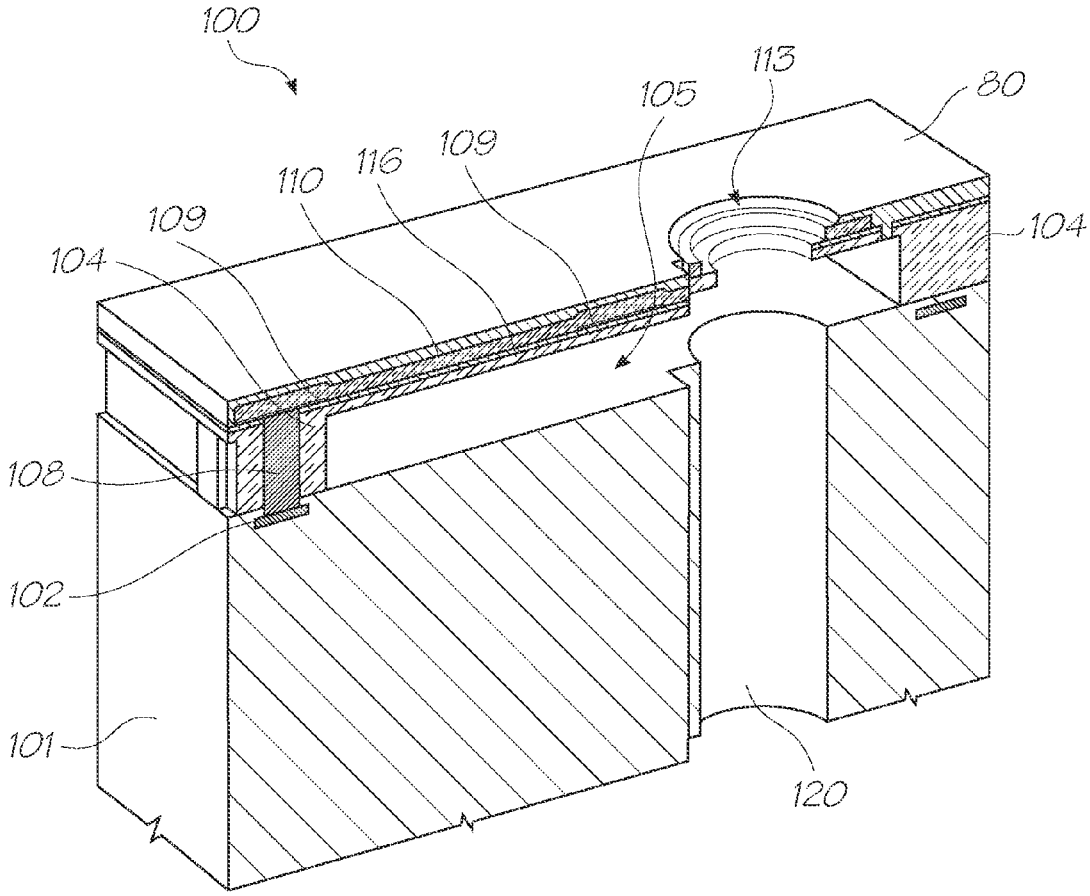
FIG. 13 is a cutaway perspective view of the inkjet nozzle assembly shown in FIG. 12.

In FIGS. 4 and 5, a roof member 107 of the nozzle chamber 105 is formed as well as highly conductive connector posts 108 extending down to the electrodes 102. Part of the roof member 107 will be used to define a passive beam 116 for the thermal bend actuator 115 in the completed inkjet nozzle assembly, as shown in FIGS. 12 and 13. In the Applicant's previous inkjet nozzle designs, the roof 107 (and thereby the passive beam of the thermal bend actuator) consists of silicon dioxide. Silicon dioxide has poor thermal conductivity, which minimizes the amount of heat conveyed away from the active beam of the thermal bend actuator during actuation. By using a passive beam having poor thermal conductivity, the overall efficiency of the device is improved. However, silicon dioxide is susceptible to cracking both during MEMS fabrication and during operation of the completed inkjet nozzle assembly. A further disadvantage of silicon dioxide is that it has a degree of permeability to aqueous ions (e.g. chloride ions), resulting in contamination of the active beam layer over time via leaching of aqueous ions from hot ink in the nozzle chamber. This mechanism of contamination can lead to failure of the active beam and the thermal bend actuator, which is highly undesirable.

Silicon nitride is less susceptible to cracking and allows a greater range of residual stresses compared to silicon dioxide—both compressive and tensile stresses. Silicon nitride is also completely impermeable, which minimizes nozzle failure via leaching of ions from ink in the nozzle chamber. However, silicon nitride has a much higher thermal conductivity than silicon dioxide, resulting in poorer efficiency of the bend actuator. Hence, silicon nitride is usually not used as the passive beam, despite having better mechanical properties than silicon dioxide.

In the present invention, the roof member 107, which defines the passive beam for the completed actuator, comprises a relatively thick layer (about 1.4 microns) of silicon nitride 131 and a relatively thin layer (about 0.1 microns) of silicon dioxide 130. Referring briefly to FIG. 12, the layer of silicon dioxide 130 is sandwiched between the active beam 110 and the layer of silicon nitride 131 in the completed actuator 115. This arrangement improves MEMS fabrication, because the roof member 107, particularly the part of the roof member 107 defining the passive beam of the thermal bend actuator, is less susceptible to cracking when the actuator is 'released' by removing the sacrificial polyimide or photoresist 106. The passive beam 116, as well as the nozzle plate of the printhead defined by contiguous roof members 107, also has improved mechanical robustness in the completed printhead without appreciably compromising thermal efficiency. Moreover, the roof member 107 does not allow any leaching of aqueous ions from hot ink towards the active beam of the thermal bend actuator. Therefore, it will be appreciated that the dual layer passive beam improves both operation of the actuator and fabrication of the actuator.

Returning now to FIGS. 5 and 6, after deposition of the bilayered roof member 107, a pair of vias are formed in the wall 104 down to the electrodes 102 using a standard anisotropic DRIE. This etch exposes the pair of electrodes 102 through respective vias. Next, the vias are filled with a highly conductive metal, such as copper, using electroless plating. The deposited copper posts 108 are subjected to CMP, stopping on the bilayered roof member 107 to provide a planar structure. It can be seen that the copper connector posts 108, formed during the electroless copper plating, meet with respective electrodes 102 to provide a linear conductive path up to the roof member 107.

Figure 7:
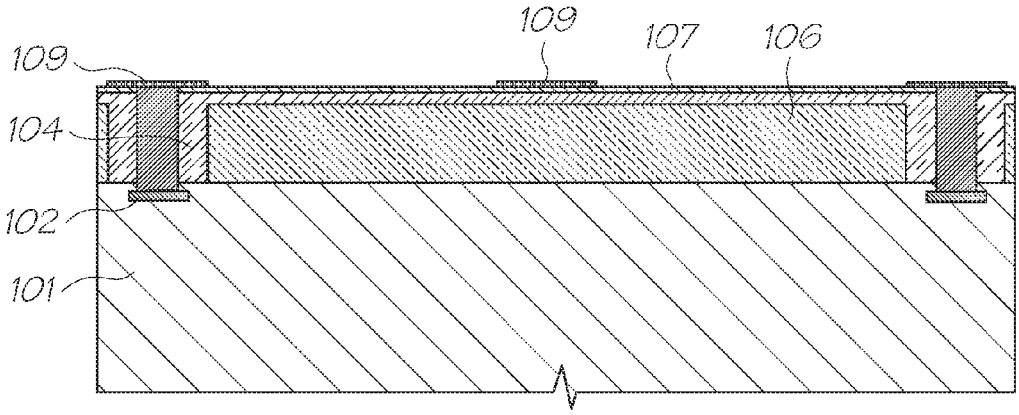
FIG. 7 is a side-sectional view of a partially-fabricated inkjet nozzle assembly after a fourth sequence of steps in which conductive metal plates are formed.
Figure 8:
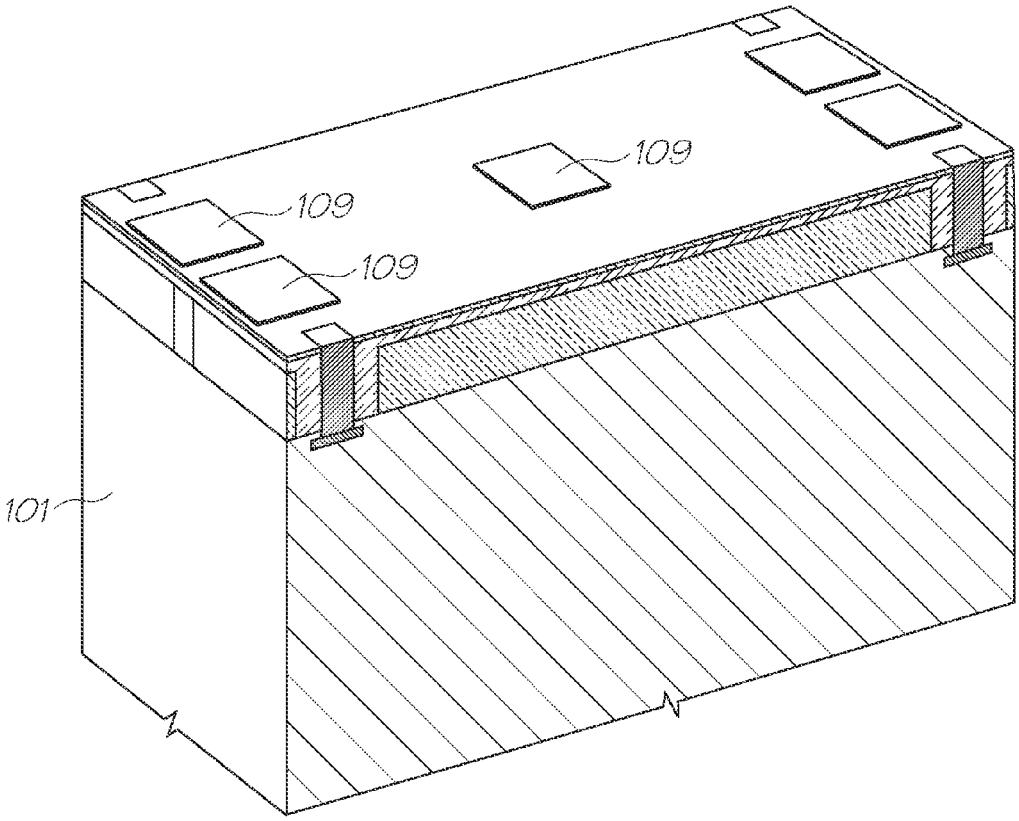
FIG. 8 is a perspective view of the partially-fabricated inkjet nozzle assembly shown in FIG. 7.

In FIGS. 7 and 8, metal pads 109 are formed by initially depositing a 0.3 micron layer of aluminium onto the bilayered roof member 107 and connector posts 108. Any highly conductive metal (e.g. aluminium, titanium etc.) may be used and should be deposited with a thickness of about 0.5 microns or less so as not to impact too severely on the overall planarity of the nozzle assembly. The metal pads 109 are positioned over the connector posts 108 and on the roof member 107 in predetermined 'bend regions' of the thermoelastic active beam member.

Figure 9:
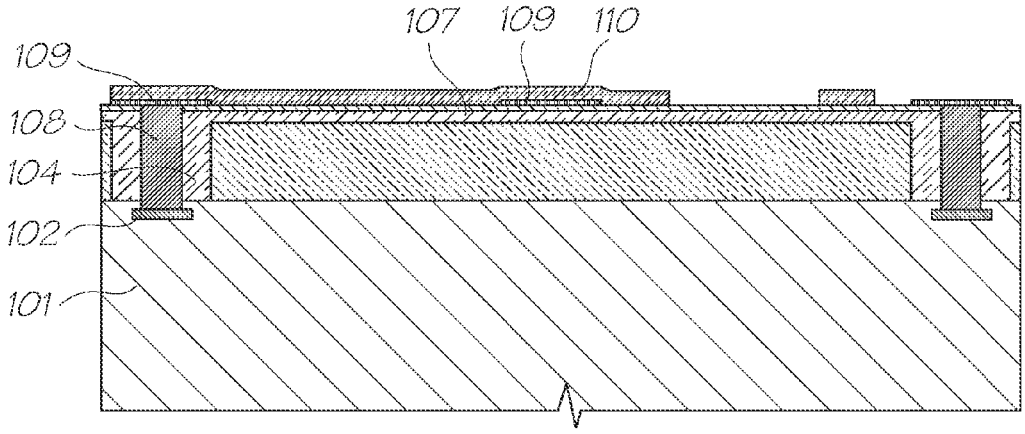
FIG. 9 is a side-sectional view of a partially-fabricated inkjet nozzle assembly after a fifth sequence of steps in which an active beam member of a thermal bend actuator is formed.
Figure 10:
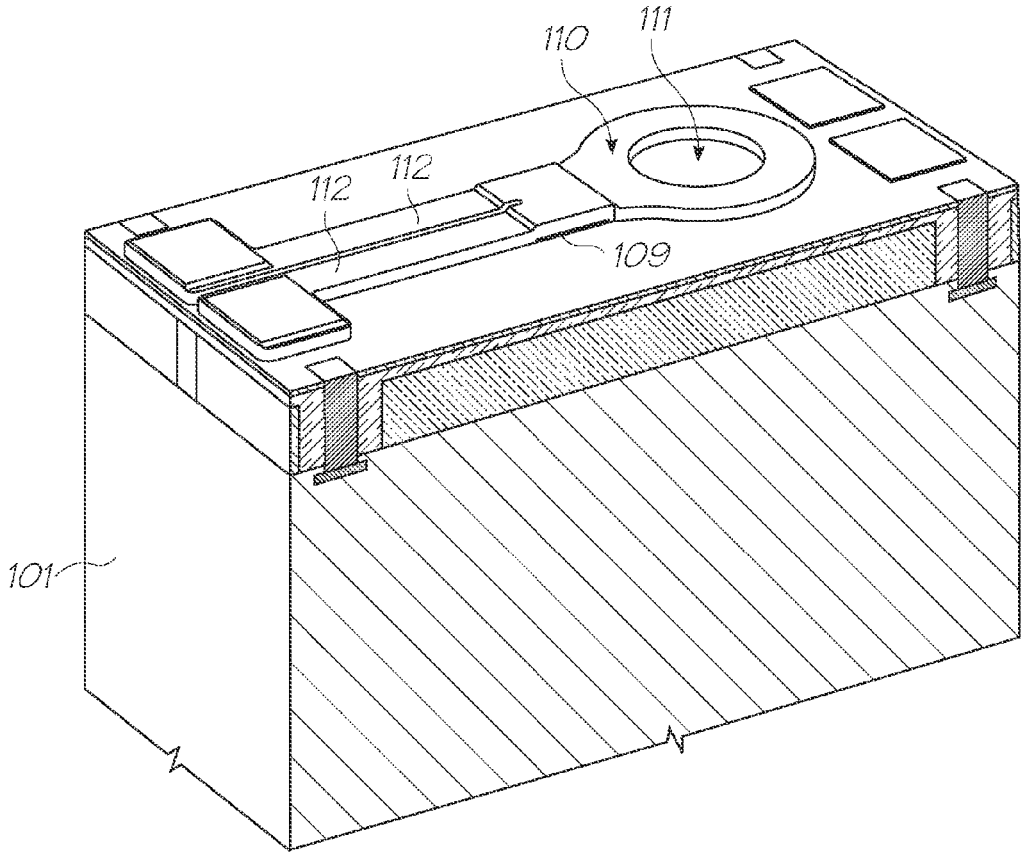
FIG. 10 is a perspective view of the partially-fabricated inkjet nozzle assembly shown in FIG. 9.

In FIGS. 9 and 10, a thermoelastic active beam member 110 is formed over the bilayered roof 107. By virtue of being fused to the active beam member 110, part of the roof member 107 functions as a lower passive beam member 116 of a mechanical thermal bend actuator, which is defined by the active beam 110 and the passive beam 116. The thermoelastic active beam member 110 may be comprised of any suitable thermoelastic material, such as titanium nitride, titanium aluminium nitride and aluminium alloys. As explained in the Applicant's earlier US Publication No. 2008/0129793 (the contents of which are herein incorporated by reference), vanadium-aluminium alloys are a preferred material, because they combine the advantageous properties of high thermal expansion, low density and high Young's modulus.

To form the active beam member 110, a 1.5 micron layer of a conductive thermoelastic active beam material is initially deposited by standard PECVD. The beam material is then etched using a standard metal etch to define the active beam member 110. After completion of the metal etch and as shown in FIGS. 9 and 10, the active beam member 110 comprises a partial nozzle opening 111 and a beam element 112, which is electrically connected at each end to positive and ground electrodes 102 via the connector posts 108. The planar beam element 112 extends from a top of a first (positive) connector post and bends around 180 degrees to return to a top of a second (ground) connector post.

Still referring to FIGS. 9 and 10, the metal pads 109 are positioned to facilitate current flow in regions of potentially higher resistance. One metal pad 109 is positioned at a bend region of the beam element 112, and is sandwiched between the active beam member 110 and the passive beam member 116. The other metal pads 109 are positioned between the top of the connector posts 108 and the ends of the beam element 112.

Figure 11:
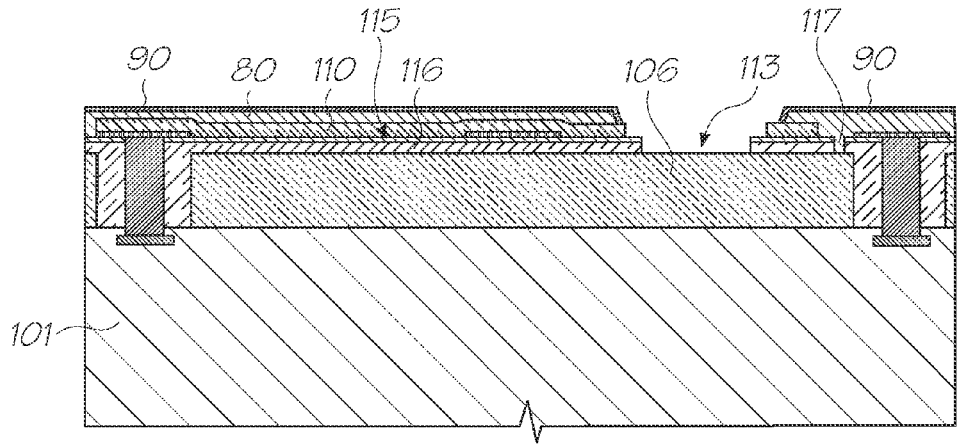
FIG. 11 is a side-sectional view of a partially-fabricated inkjet nozzle assembly after a sixth sequence of steps after coating with a polymeric layer, protecting with a metal layer and etching a nozzle opening.

Referring to FIG. 11, a hydrophobic polymer layer 80 is deposited onto the wafer and covered with a protective metal layer 90 (e.g. 100 nm aluminum). After suitable masking, the metal layer 90, the polymer layer 80 and the bilayered roof member 107 are then etched to define fully a nozzle opening 113 and a moving portion 114 of the roof.

The moving portion 114 comprises a thermal bend actuator 115, which is itself comprised of the active beam member 110 and the underlying passive beam member 116. The nozzle opening 113 is defined in the moving portion 114 of the roof so that the nozzle opening moves with the actuator during actuation. Configurations whereby the nozzle opening 113 is stationary with respect to the moving portion 114, as described in US Publication No. 2008/0129793, are also possible and within the ambit of the present invention.

A perimeter region 117 around the moving portion 114 of the roof separates the moving portion from a stationary portion 118 of the roof. This perimeter region 117 allows the moving portion 114 to bend into the nozzle chamber 105 and towards the substrate 101 upon actuation of the actuator 115. The hydrophobic polymer layer 80 fills the perimeter region 117 to provide a mechanical seal between the moving portion 114 and stationary portion 118 of the roof 107. The polymer has a sufficiently low Young's modulus to allow the actuator to bend towards the substrate 101, whilst preventing ink from escaping through the gap 117 during actuation.

The polymer layer 80 is typically comprised of a polymerized siloxane, which may be deposited in a thin layer (e.g. 0.5 to 2.0 microns) using a spin-on process and hardbaked. Examples of suitable polymeric materials are poly(alkylsilsesquioxanes), such as poly(methylsilsesquioxane); poly(arylsilsesquioxanes), such as poly(phenylsilsesquioxane); and poly(dialkylsiloxanes), such as a polydimethylsiloxane. The polymeric material may incorporate nanoparticles to improve its durability, wear-resistance, fatigue-resistance etc.

In the final MEMS processing steps, and as shown in FIGS. 12 and 13, an ink supply channel 120 is etched through to the nozzle chamber 105 from a backside of the substrate 101. Although the ink supply channel 120 is shown aligned with the nozzle opening 113 in FIGS. 12 and 13, it could, of course, be positioned offset from the nozzle opening.

Following the ink supply channel etch, the polyimide 106, which filled the nozzle chamber 105, is removed by ashing in an oxidizing plasma and the metal film 90 is removed by an HF or $H_2O_2$ rinse to provide the nozzle assembly 100.

It will be appreciated by ordinary workers in this field that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. A method of fabricating a thermal bend actuator comprising the steps of:

(a) depositing a first layer comprised of silicon nitride onto a sacrificial scaffold;

(b) depositing a second layer comprised of silicon dioxide onto the first layer;

(c) depositing an active beam layer onto said second layer;

(d) etching said active beam layer, said first layer and said second layer to define the thermal bend actuator, said thermal bend actuator comprising an active beam and a passive beam, said passive beam comprising said first and second layers; and (e) releasing said thermal bend actuator by removing said sacrificial scaffold.

2. The method of claim 1, wherein said first layer is thicker than said second layer.

3. The method of claim 1, wherein said first layer is at least four times thicker than the second layer.

4. The method of claim 1, wherein the second layer has a thickness in the range of 0.05 and 0.2 microns.

5. The method of claim 1, wherein the first layer has a thickness in the range of 1.0 and 2.0 microns.

6. The method of claim 1, wherein the active beam layer has a thickness in the range of 1.5 and 2.0 microns.

7. The method of claim 1, wherein said sacrificial scaffold is comprised of photoresist or polyimide.

8. The method of claim 1, wherein said sacrificial scaffold is removed by an oxidative plasma.

9. The method of claim 1, wherein the active beam layer is comprised of a material selected from the group consisting of: titanium nitride, titanium aluminium nitride and an aluminium alloy.

10. The method of claim 1, wherein the active beam is comprised of a vanadium-aluminium alloy.

11. The method of claim 1, wherein residual stresses in said passive beam after release of said thermal bend actuator reside predominantly in said first layer.

12. The method of claim 1, wherein said method defines at least part of a MEMS fabrication process for an inkjet nozzle assembly.

13. The method of claim 12, wherein said first and second layers define a roof of a nozzle chamber.

14. The method of claim 13, wherein said roof comprises a moving portion, said moving portion including said thermal bend actuator.

15. The method of claim 14, wherein a nozzle opening is defined in said roof prior to release of said thermal bend actuator.

16. The method of claim 15, wherein said nozzle opening is defined in the moving portion of said roof.

17. The method of claim 13, wherein said roof is coated with a polymeric material prior to releasing said thermal bend actuator.

18. The method of claim 17, wherein said polymeric material is protected with a metal layer prior to releasing said thermal bend actuator.

19. The method of claim 17, wherein said polymeric material is coated on said roof by a spin-on process.

20. The method of claim 17, wherein said polymeric material is a polymerized siloxane.

* * * * *